United States Patent [19]

VanOursouw et al.

[11] Patent Number: 4,777,736

[45] Date of Patent: Oct. 18, 1988

[54] SYSTEM FOR DRYING WEB MATERIAL UTILIZING REMOVABLE/ADJUSTABLE NOZZLE

[75] Inventors: Leo A. VanOursouw, Kimberly; James M. Miller, Oshkosh, both of Wis.; James M. Blair, Hoffman Estates, Ill.; Ronald Kuettel, Hortonville, Wis.

[73] Assignee: Thermo Electron - Web Systems, Inc., Auburn, Mass.

[21] Appl. No.: 68,970

[22] Filed: Jul. 1, 1987

[51] Int. Cl.[4] ..... F26B 13/00

[52] U.S. Cl. ..... 34/156; 34/160

[58] Field of Search ..... 34/156, 155, 160

[56] References Cited

U.S. PATENT DOCUMENTS

| | | | |
|---|---|---|---|
| 3,220,061 | 11/1965 | Johnson et al. | 229/97 X |
| 3,587,177 | 6/1971 | Overly et al. | 34/160 X |
| 4,414,757 | 11/1983 | Whipple | 226/97 X |
| 4,467,537 | 8/1984 | Trotscher | 34/155 |

*Primary Examiner*—Steven E. Warner

*Attorney, Agent, or Firm*—Lorusso & Loud

[57] ABSTRACT

A flotation drying system utilizing a nozzle assembly having a mounting system that enables quick assembly and disassembly of the system. The nozzle assembly comprises one or more high pressure supply headers or bulkheads, a nozzle housing extending across the grooved face of the one or more bulkheads in a perpendicular direction to the direction of the bulkhead, the nozzle housing having a port connecting it to the bulkhead so that a stream of air goes through the nozzle housing and is applied to the web for drying. The nozzle assembly comprises sealing plates removably supported by the groove face of the bulkhead adjacent each of the nozzle housings to seal the area between the nozzle housings. A flange extends from each of the nozzle housings over the sealing plates as a means to seal the nozzle housings to the grooved face of the bulkhead. In addition, clamping means are provided adjacent the nozzle housing an on the bulkhead to urge the flange against the sealing plate, and the clamping means places the bulkhead, the nozzle housings and each of the sealing plates in a fluid tight relationship with each other. The clamping means may be provided on one or both sides of the bulkhead, and will generally comprise a clamping support and toggle clamp arrangement.

18 Claims, 1 Drawing Sheet

SYSTEM FOR DRYING WEB MATERIAL UTILIZING REMOVABLE/ADJUSTABLE NOZZLE

BACKGROUND OF THE INVENTION

The present invention relates to a system for drying web material and more particularly, to a system utilizing nozzles which can be removed and/or adjusted conveniently and quickly.

For nearly two centuries, the dominant system for drying continuous webs has been a series of rotating steam heated cylinders. When drying surface coatings on paper webs, the alternating contact of the web with the metal cylinder results in picking and other quality defects. This problem was a primary stimulus for the development of flotation drying systems that simultaneously support and convectively dry the web on a cushion of high velocity hot air. In the past twenty years, flotation drying has evolved into the dominant method for drying coated webs. Examples of nozzle assemblies utilized for flotation drying are taught by U.S. Pat. Nos. 3,587,177 and 4,414,757.

With a typical flotation web drying installation, the drying is accomplished by an array of nozzles positioned on each side of the web. Heated air is transported to the nozzles by a system of headers to which the air is supplied by ducts. A similar duct collects the air after it leaves the vicinity of the web.

There are various types of flotation drying nozzles. One known type of nozzle, which is taught by U.S. Pat. Nos. 3,587,177, the teachings of which are incorporated herein by reference, utilizes a "negative" pressure gas cushion to support and dry the web. U.S. Pat. No. 4,414,757 teaches another known type of nozzle, utilizing a "positive" pressure to float and dry the web, and the teachings of this patent are also incorporated herein by reference. This nozzle also imparts an undulating web flow characteristic which is preferable for most drying applications, and such nozzles display very uniform machine-direction heat transfer. Positive pressure nozzles are tolerant of a very large range of web tensions, and they allow the web to resist the formation of edge curls.

Flotation drying systems utilizing either type of nozzles, however, have not proven to be easily adaptable for use in special applications. In laboratory research and development work, it is highly desirable to have a method of quickly changing nozzle spacings to develop heat transfer data. In production applications, it is desirable to have a method of quick removal for cleaning and quick replacement to an exact previous location to maintain exact heat transfer characteristics. In known nozzle assemblies, these objectives cannot be obtained.

Accordingly, it is an object of the present invention to provide a nozzle assembly for use in flotation drying systems which can be quickly assembled and disassembled.

It is another object of the present invention to provide a nozzle assembly for flotation drying systems which incorporates a method of quickly changing nozzle spacings to develop heat transfer data.

It is a further object of the present invention to provide a nozzle assembly for flotation drying systems, which can be quickly removed for cleaning and/or quickly replaced to the exact previous location to maintain exact heat transfer characteristics of the web.

SUMMARY OF THE INVENTION

The flotation drying system of the present invention utilizes a nozzle assembly having a mounting system that enables quick assembly and disassembly of the system. The nozzle assembly comprises a supply header or bulkhead which supplies a gas (typically air) through a cross machine slot orifice to form a linear jet. A nozzle housing extends across the grooved face of the bulkhead in a perpendicular direction to the direction of the bulkhead. The nozzle housing has a port connecting it to the bulkhead so that a stream of air goes through the nozzle housing and is applied to the web for drying. Sealing plates are removably supported by the grooved face of the bulkhead adjacent each of the nozzle housings to seal the area between nozzle housings. A flange extends from each of the nozzle housings over the sealing plates as a means to seal the nozzle housings to the grooved face of the bulkhead. In addition, clamping means are provided adjacent the nozzle housing and on the bulkhead to urge the flange against the sealing plate, and the clamping means places the bulkhead, the nozzle housings and each of the sealing plates in a fluid-tight relationship with each other. This clamping means may be provided on one or both sides of the bulkhead.

These and other features and objects of the present invention will be more clearly understood from the following detailed description which should be read in light of the accompanying drawings in which corresponding reference numerals refer to corresponding parts throughout the several views.

DETAILED DESCRIPTION OF THE PREFERRED EMBODIMENT

Figure 1:
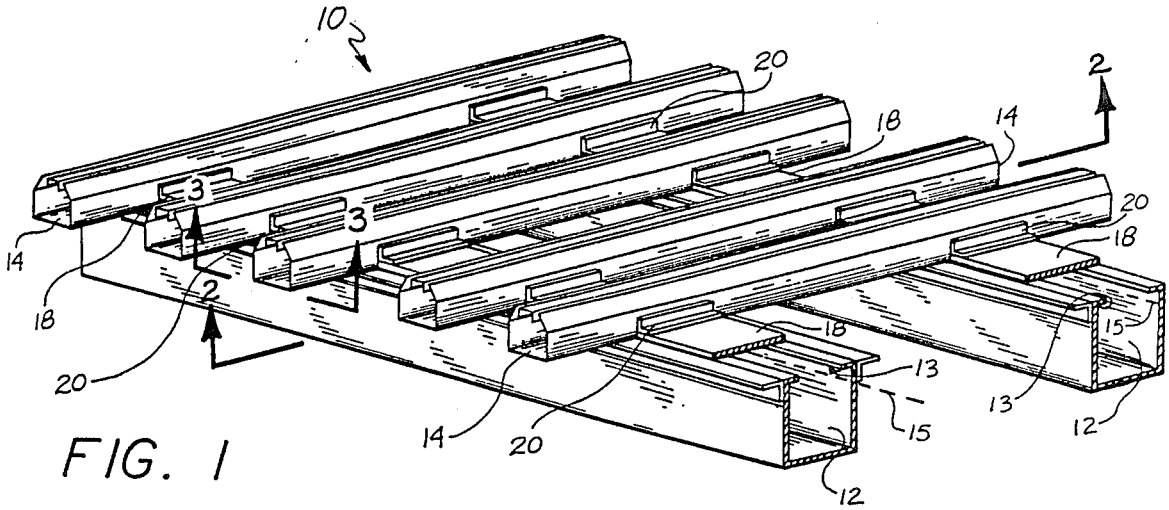
FIG. 1 is a plan view of one embodiment of the removable/adjustable nozzle assembly of the present invention.

A nozzle assembly 10 of the present invention, as shown in the figures, includes a supply header or bulkhead 12, nozzle housing 14, a port 16 in the nozzle housing 14 communicating with the bulkhead 12, sealing plates 18 removably supported by the bulkhead 12, flanges 20 extending from the nozzle housings and urging means 22 to urge the flange 20 against the sealing plates 18 to provide a sealed relationship between the sealing plates 18, the bulkhead 12 and the nozzle housings 14.

The bulkhead 12 as used in the present invention is generally a low pressure (typically 1 to 16 inches of water columns) gas supply header which extends over the length of the nozzle. The bulkheads include a plurality of supply ducts (not shown) which conduct the gas supply to the nozzles from which it flows through the nozzle slot orifices at high velocity (typically 4,000 to 14,000 ft/min). There may be one or two bulkheads in the nozzle assembly of the present invention. In a preferred embodiment, the bulkhead 12 will be rectangularly shaped. A groove 13 extends longitudinally along the face of the bulkhead 12, and extends in the same direction as that of the bulkhead 12. This groove 13 forms a central longitudinal axis 15 along the face of the bulkhead 12. A rod 17 is welded inside the bulkhead 12 to hold and maintain the correct groove 13 for the full length of the bulkhead 12.

One or more nozzle housings 14 are spaced along the groove in the face of the bulkhead 12. These nozzle housings 14 extend in a direction perpendicular to the groove in the face of the bulkhead 12. The nozzle housings 14 provide a means for conducting the gas stream under pressure to the web, and each of the nozzle housings 14 has a port 16 communicating with the longitudinal groove 13 of the bulkhead 12. Gas passes from the bulkhead 12 through the port 16 into the nozzle housing 14, from which it is conducted under pressure to the web.

Flat sealing plates 18 are provided between the nozzle housings 14. These plates 18 have several purposes. First, they seal the area between the nozzle housings 14 so that the air from the bulkhead 12 is directed only through the nozzle housing 14. These plates 18 can be moved to provide the correct desired center distance between each of the nozzle housings so that air or gas flow to the web is positioned to provide the most advantageous drying effects. In a preferred embodiment, the flat plates 18 are each of uniform length, and may be uniformly spaced across the grooved face of the bulkhead 12 so that the nozzle housings 14 are uniformly spaced. The sealing plates 18 will generally be rectangular. They are placed in contact with the nozzle housings 14 and having a common surface so that no air is directed out between the nozzle housings 14 and is entirely directed through the nozzle housings 14. The sealing plates 18 are removable to permit placement changes.

Generally, the nozzle housings 14 will be placed at set positions along the bulkhead. Alternatively, it may be desirable to test various drying positions to find which provides the best drying conditions for the particular application. Because the groove 13 extends along the entire face of the bulkhead 12, the nozzle housings 14 can be mounted in various locations, although it is usually preferable to space them evenly along the bulkhead 12 so that the center line from one nozzle to the center line of the next or adjacent nozzle is an equal distance.

A flange 20 extends from the nozzle housing 14 to releasably seal with the groove 13 in the bulkhead 12 to guide the nozzle housing 14 into the correct position relative to the bulkhead 12. The flange 20 on the nozzle housing 14 is mounted across the groove 13 and secures the position of the nozzle housings 14. In a preferred embodiment, the flange is L-shaped.

Urging means 22 are provided on one or both sides of the bulkhead 12 to secure the bulkhead 12 to the nozzle housing 14. The urging means 22 pull the flange 20 down against the nozzle housing 14. In addition, these clamps 22 urge the sealing plates 18 against the flange 20 and place the bulkhead 12, the nozzle housings 14 and each of the plates 18 in a fluid-tight relationship with each other.

Figure 2:
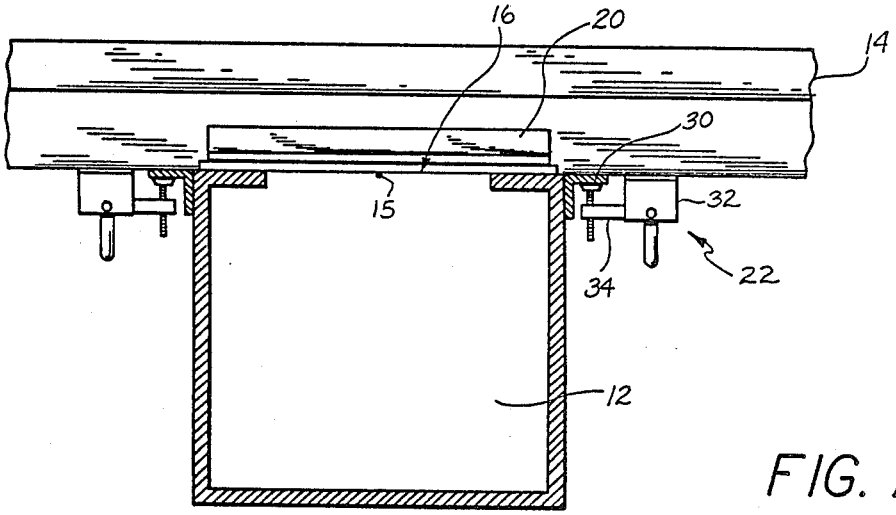
FIG. 2 is a cross-sectional view of the nozzle assembly shown in FIG. 1, taken along the line 2—2 of FIG. 1.
Figure 3:
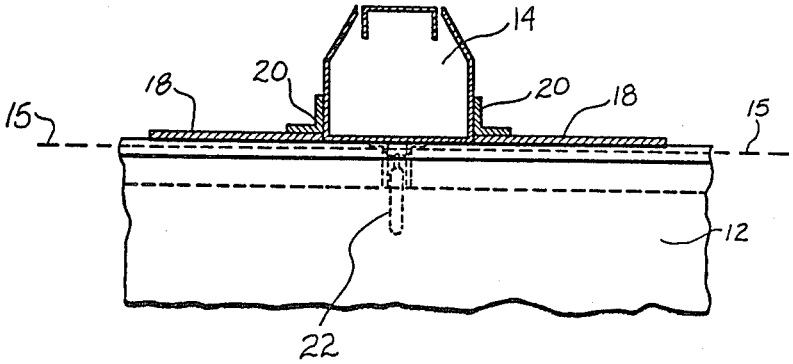
FIG. 3 is a cross-sectional view of the nozzle assembly of FIG. 1, taken along the line 3—3 in FIG. 1.

As shown in FIG. 2, the urging means 22 will generally comprise a clamping support 30, a clamping means 32 and a connecting member 34. The clamping support 30 generally extends in the same direction as the nozzle housing from the bulkhead 12, and can be an L-shaped flange. The connecting member 34, movable against and away from the clamping support 30, connects it to the clamping means 32, which are anchored to the nozzle housings 14. This clamping means 32 may be a toggle clamp. The advantages of the toggle clamp 32 is that it provides for quick removal and assembly of the nozzle housings 14, and it also permits adjustable center distances between the nozzle housings 14. When the urging means 22 are in place, it urges the flange 20 on the housing against the adjacent plate 18, and it places the bulkhead 12, the nozzle housing 14 and each of the plates 18 in a fluid-tight relationship with each other.

The nozzle assembly of the present invention, when used in flotation drying systems, provide a way to adjust and change the nozzle housings. The nozzles may also be removed for cleaning, and the nozzles are quickly replacable to their exact previous location prior to removal. In this way, it will be easy to develop heat transfer data, and it will also be easy to replace the housings to maintain the exact heat transfer characteristics that had previously been in place and that are desirable.

While the foregoing invention has been described with reference to its preferred embodiments, various alterations and modifications will occur to those skilled in the art. All such alterations or modifications are intended to fall within the scope of the appended claims.

What is claimed is:

1. A nozzle assembly that can be quickly assembled and disassembled, comprising:

means for conducting a gas stream under pressure having a groove extending along a central longitudinal axis of a face thereof, said means for conducting a gas stream under pressure lying in a first direction, said first direction being parallel to said central longitudinal axis;

a plurality of spaced nozzle housings extending in a second direction across said grooved face of said means for conducting a gas stream under pressure, said second direction being perpendicular to said first direction, each of said nozzle housings having a port communicating with said groove;

means for sealing said groove between said spaced nozzle housings, said means for sealing being removably supported by said grooved face and adjacent each of said spaced nozzle housings;

means for fixing said means for sealing to said grooved face, said means for fixing extending from each of said nozzle housings over said means for sealing;

means for urging each of said means for fixing against each of said means for sealing wherein said means for urging includes, a clamping support, and clamping means anchored to each of said nozzle housings, said clamping means having a connecting member movable against and away from said clamping support;

whereby moving said connecting member against said clamping support urges said nozzle housing towards said means for conducting a gas stream under pressure, forcing said means for fixing against said means for sealing which places said means for conducting, said plurality of nozzle housing, and each of said means for sealing in a fluid tight relationship with one another.

2. The nozzle assembly as recited in claim 1 wherein said means for sealing are of a uniform length and said nozzle housings are uniformly spaced across said grooved face by said means for sealing of uniform length.

3. The nozzle assembly as recited in claim 1 wherein said clamping means comprises a toggle clamp.

4. The nozzle assembly as recited in claim 1 wherein said clamping support comprises a first and a second clamping support, said first clamping support extending in said second direction from a side of said means for conducting a gas stream under pressure and said second clamping support extending in said second direction from an opposite side of said means for conducting a gas stream under pressure; and wherein said clamping means comprises a first clamping means and a second clampig means, said first clamping means having a connectable member movable against and away from said first clamping support, and said second clamping means having a connectable member movable against and away from said second clamping support, said first clamping means anchored to a side of said nozzle housing and said second clamping means anchored to a side opposite to the side of said nozzle housing to which said first clamping means are anchored.

5. The nozzle assembly as recited in claim 1 wherein said clamping support includes a first and a second clamping support; and said clamping means includes a first and a second clamping means said first clamping means having a connecting member movable against and away from said first clamping support and said second clamping means having a connecting member movable against and away from said second clamping support, said first clamping means anchored to said nozzle housing on a first clamping support side thereof and said second clamping means anchored to said nozzle housing on a second support side thereof;

said first clamping support extending from a side of said means for conducting a gas stream under pressure in said second direction and said second clamping support extending from a side of said means for conducting a gas stream under pressure opposite to the side on which said first clamping support extends in said second direction.

6. The nozzle assembly as recited in claim 1 wherein said means for sealing comprises rectangular plates having a sufficient width to cover said groove.

7. The nozzle assembly as recited in claim 6 wherein said rectangular plates are in contact with said spaced nozzle housings and have a common surface therewith.

8. The nozzle assembly as recited in claim 1 wherein said means for fixing extend from each of said nozzle housings in said first direction.

9. The nozzle assembly as recited in claim 8 wherein said means for fixing extending from said nozzle housings in said first direction includes an L-shaped flange.

10. The nozzle assembly as recited in claim 1 wherein said clamping support extends from said means for conducting gas stream under pressure.

11. The nozzle assembly as recited in claim 10 wherein said clamping support which extends from said means for conducting a gas stream under pressure comprises an L-shaped flange.

12. The nozzle assembly as recited in claim 11 wherein said L-shaped flange extends from said means for conducting a gas stream under pressure in said second direction.

13. A nozzle assembly that can be quickly assembled and disassembled comprising:

means for conducting a gas stream under pressure, said means for conducting a gas stream under pressure being rectangularly shaped and having a groove extending along a central longitudinal axis of a face thereof, said means for conducting a gas stream under pressure lying in a first direction, said first direction being parallel to said central longitudinal axis;

a plurality of space nozzle housings extending in a second direction across said longitudinally grooved face, said second direction being perpendicular to said first direction, each of said nozzle housings having a port communicating with said groove;

a plurality of flat plates, each of said flat plates supported by said grooved face and positioned adjacent each of said nozzle housings, said plurality of flat plates sealing said longitudinal groove between said nozzle housings;

an L-shaped flange extending from each of said nozzle housings in said first direction over said flat plate;

an L-shaped clamping support extending from said means for conducting a gas stream under pressure in said second direction; and a toggle clamp anchored to each of said nozzle housings having a connecting member movable against and away from said L-shaped clamping support;

whereby moving said connecting member against said L-shaped clamping support places said means for conducting a gas stream under pressure, said plurality of nozzle housings and each of said flat plates in a fluid-tight relationship with each other.

14. The nozzle assembly as recited in claim 13 wherein said L-shaped clamping support extends from a side of said means for conducting a gas stream under pressure and said toggle clamp is anchored to a side of said nozzle housing, said assembly further comprising:

a second L-shaped clamping support extending in said second direction from a side opposite the side of said means for conducting a gas stream under pressure to which said first L-shaped clamping support extends from said means for conducting a gas stream under pressure; and a second toggle clamp anchored to a side of said nozzle housing opposite to that which said first toggle clamp is anchored, said second toggle clamp having a connecting member movable against and away from said second L-shaped clamping support.

15. The nozzle assembly as recited in claim 14 wherein said L-shaped clamping support extends from a side of said means for conducting a gas stream under pressure, said assembly further comprising a second L-shaped clamping support extending in said second direction from a side of said means for conducting a gas stream under pressure opposite to that which the first toggle clamp is anchored, and a second toggle clamp.

16. A nozzle assembly that can be quickly assembled and disassembled, comprising:

first and second means for conducting a gas stream under pressure, said first and second means for conducting a gas stream under pressure disposed in parallel and having a groove extending longitudinally along a central longitudinal axis of a face thereof, said first and said second means for conducting a gas stream under pressure lying in a first direction, said first direction being parallel with said central longitudinal axis;

a plurality of spaced nozzle housing extending in a second direction across said grooved faces of said first and second means for conducting a gas stream under pressure, said second direction being perpendicular to said first direction, each of said nozzle housings having a first port communicating with said groove of said first means for conducting a gas stream under pressure and a second port for communicating with said groove of said second means for conducting a gas stream under pressure;

means for sealing said longitudinal grooves between said spaced nozzle housings, said means for sealing removably supported by each of said grooved faces and adjacent each of said spaced nozzle housings;

means for fixing said means for sealing to each of said grooved faces of said means for conducting a gas stream under pressure, and said means for fixing extending from each of said nozzle housings over said means for sealing, wherein said means for fixing comprise a plurality of first and second L-shaped flanges each of said first L-shaped flanges extending in said first direction over a means for sealing supported from said nozzle housings and each of said second L-shaped flanges extending from said nozzle housings in said first direction over a means for sealing supported along said second means for conducting a gas stream under pressure;

means for urging each of said means for fixing against each of said means for sealing;

whereby urging each of said means for fixing against each of said means for sealing places said first and second means for conducting gas under pressure, said plurality of nozzle housings and each of said means for sealing in fluid tight relationship with each other.

17. The nozzle assembly as recited in claim 16 wherein said means for urging comprises:

first and second L-shaped clamping support flanges, said first L-shaped clamping support flange extending in said second direction from a side of first means for conducting a gas stream under pressure and said second L-shaped clamping support flange extending in said second direction from a side of said second means for conducting a gas stream under pressure; and first and second clamping means, said first clamping means anchored to an end of said nozzle housing on a side of said first means for conducting a gas stream under pressure and having a connecting member movable against and away from said first L-shaped clamping support flange, and said second clamping means anchored to an opposite end of said nozzle housing on a side of said second means for conducting a gas stream under pressure having a connecting member movable against and away from said second L-shaped clamping support flange.

18. The nozzle assembly recited in claim 16 further comprising:

third and fourth L-shaped clamping support flanges, said third L-shaped clamping support flange extending in said second direction from a side of said first means for conducting a gas stream under pressure opposite said first L-shaped clamping support flange and said fourth L-shaped clamping support flange extending in said second direction from a side of said second means for conducting a gas stream under pressure opposite said second L-shaped clamping support flange; and third and fourth clamping means said third clamping means anchored to an end of said nozzle housing on a side of said first means for conducting a gas stream at high pressure opposite said first clamping means having a connecting member movable against and away from said third L-shaped clamping support flange and a fourth clamping means anchored to said opposite end of said nozzle housing on a side of said second means for conducting a gas stream opposite said second clamping means having a connecting member movable against and away from said fourth L-shaped clamping support flange.

* * * * *